US006257413B1

(12) United States Patent
Tolvanen

(10) Patent No.: US 6,257,413 B1
(45) Date of Patent: Jul. 10, 2001

(54) SCREEN PANEL

(75) Inventor: Mika Tolvanen, Sundsvall (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/530,383

(22) PCT Filed: Nov. 9, 1998

(86) PCT No.: PCT/SE98/02018

§ 371 Date: Apr. 27, 2000

§ 102(e) Date: Apr. 27, 2000

(87) PCT Pub. No.: WO99/24663

PCT Pub. Date: May 20, 1999

(30) Foreign Application Priority Data

Nov. 7, 1997 (SE) ..... 9704093

(51) Int. Cl.[7] ..... B07B 1/49

(52) U.S. Cl. ..... 209/407; 209/363; 209/370; 209/392; 209/406

(58) Field of Search ..... 209/363, 370, 209/392, 406, 407, 288, 301, 302, 303; 210/784, 787

(56) References Cited

U.S. PATENT DOCUMENTS 4,374,729 2/1983 Frykhult ..... 210/232
4,986,900 * 1/1991 Mason ..... 209/397

FOREIGN PATENT DOCUMENTS 0 287 267 A2 10/1988 (EP) .
0 357 382 A2 3/1990 (EP) .
0357382-A2 * 3/1990 (EP) ..... D21D/5/16
441 108 9/1985 (SE) .

* cited by examiner

*Primary Examiner*—Donald P. Walsh
*Assistant Examiner*—Mark Beauchaine
(74) *Attorney, Agent, or Firm*—Lerner, David, Littenberg, Krumholz & Mentlik, LLP

(57) ABSTRACT

Screen panels are disclosed which are adapted to form a portion of a screening cylinder for screening fibrous material. The screen panels are unitary and made of wear-resistant material including a plurality of axially extending grooves on the outer surface of the screen panel, a plurality of slit-shaped screening orifices disposed at the bottom of the axial grooves, at least one support ring extending circumferentially across the surface of the screen panel and integral therewith, and a flange is formed at the sides of the screen panel so that the screen panels can be assembled together without the use of welding.

6 Claims, 1 Drawing Sheet

SCREEN PANEL

FIELD OF THE INVENTION

The present invention relates to a screen for screening fiber material. More particularly, the present invention is directed to a screen panel for such a screen.

BACKGROUND OF THE INVENTION

During the screening of fiber material, such as fiber suspensions of cellulosic material, the object is generally to separate coarse particles in the form of shives, fiber bundles or other impurities from the fiber material. The screening is usually carried out in a screen with a screening cylinder, which can be stationary or rotary. The screening cylinder is generally provided with holes or slits, through which the fiber, but not the impurities, can pass.

Screening cylinders of this type are usually manufactured by drilling holes or milling slits in a metal sheet, which is then formed into a cylinder. In order to obtain an open area, i.e. that portion of the cylinder surface which is perforated as much as possible, the holes or slits must be arranged in a tight relationship. At the same time, the strength of the cylinder must be maintained. This therefore requires high precision work.

Particularly during the manufacture of slitted cylinders, which in certain cases are more advantageous than cylinders with holes which are drilled, difficulties concerning the strength arise, because the material between the slits will become rather thin. The slits, therefore, must be made short and arranged at a certain relationship from each other. This, in turn, results in a certain restriction of the open area.

One way to solve this problem is to form the cylinder from a great number of bars, which are kept in place by annular strips. This, however, is a complicated and expensive way of manufacturing a screening cylinder. It is, furthermore, difficult to provide the slits with a uniform width across the entire cylinder.

SUMMARY OF THE INVENTION

In accordance with the present invention, this and other difficulties have been solved by the invention of a screen panel adapted to constitute a portion of a screening cylinder for the screening of fibrous material, the screen panel comprising a unitary screen panel of wear-resistant material having a first surface, a second surface, an upper edge, a lower edge, and a pair of side edges, the first surface including a plurality of axially extending grooves, a plurality of slit-shaped screening orifices disposed at the bottom of the plurality of axially extending grooves, at least one support ring extending circumferentially across the first surface and being integral with the screen panel, and assembly means for assembling the screen panel into the screening cylinder without the use of welding. Preferably, the screen panel includes a plurality of the support rings.

In accordance with one embodiment of the screen panel of the present invention, the screen panel includes a plurality of recesses on the second surface of the screen panel at a location directly in front of the plurality of axially extending grooves.

In accordance with another embodiment of the screen panel of the present invention, the plurality of slit-shaped screening orifices have a slit width of between about 0.5 and 1 mm.

In accordance with another embodiment of the screen panel of the present invention, the assembly means comprises at least one flange formed on one of the pair of side edges. Preferably, the assembly means further comprises additional fastening members disposed along the top and bottom edges of the screen panel.

According to the present invention, these problems are thus solved by forming the screen from a number of screen panels, which together form a screening cylinder, i.e. each screen panel constitutes one portion of the circumference of the screening cylinder. One screen panel can possibly extend around the entire circumference of the screening cylinder. The screen panels are manufactured individually by being formed in one piece, whereafter the screen orifices are provided in the panels. Several panels are thereafter assembled to form a screening cylinder.

The forming of the panels can be carried out by casting, compression molding or the like, of a material which is a suitable wear-resistant metal alloy or ceramic material, for example alumina. Such material is not weldable. The screen panels, thus, must be joined together without welding.

Each panel is formed with a curvature radius, which substantially corresponds to the radius of the screening cylinder. The panel is also formed with a great number of substantially axial grooves and a number of support rings, which extend substantially in the circumferential direction. These support rings are formed as an integral part of the panel. These rings are located on the same side of the screen panel as are the grooves. On the opposite side of the panel recesses are preferably formed, which are located directly in front of the grooves. The panel is also formed with edge flanges, by means of which several panels can be assembled in the circumferential direction. Fastening means can be formed along the curved edges for attaching the panels axially to one another.

After their forming, the panels are provided with screening orifices, which are cut in the form of substantially axial slits. This is preferably carried out by precision grinding, by means of which a slit width of about 0.1 to 1 mm can be obtained. The slits are placed in relation to the grooves, preferably at the bottom thereof. The screening orifices are cut out from the opposite side in relation to the grooves and support rings, so that the slits extend through the panel to the bottom of the grooves, but not through the support rings. Thereby a maximum open area is obtained, and at the same time the strength of the screen panel is maintained.

BRIEF DESCRIPTION OF THE DRAWINGS

The present invention is described in greater detail in the following detailed description, with reference to the accompanying Figures illustrating an embodiment of the screen panel according to the present invention, as follows.

DETAILED DESCRIPTION

Figure 1:
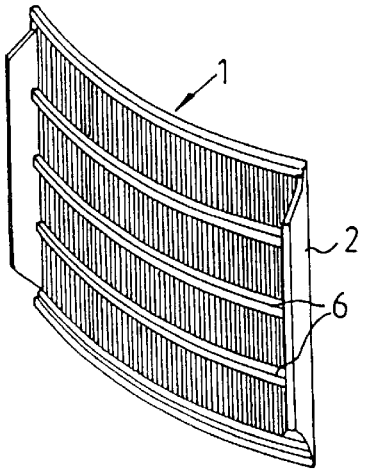
FIG. 1 is a front, perspective view of a screen panel according to the present invention.

The screen panel 1 shown in FIG. 1 constitutes a portion of the jacket surface of a screening cylinder, as seen in the circumferential direction. The entire screening cylinder is formed by the assembling of a plurality of screen panels. Each screen panel, therefore, is formed with edge flanges 2 for attachment by bolts or in some other way, but not by welding. For assembling these panels axially, the panels are provided with fastening means 3, also along the curved edges for being attached together without welding.

Figure 4:
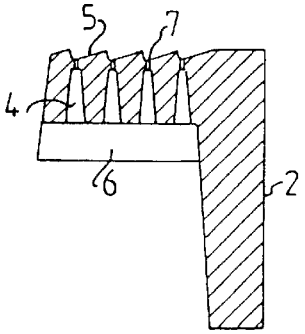
FIG. 4 is a side, elevational, sectional view of the screen panel of FIG. 2, taken along line IV—IV in FIG. 2.
Figure 2:
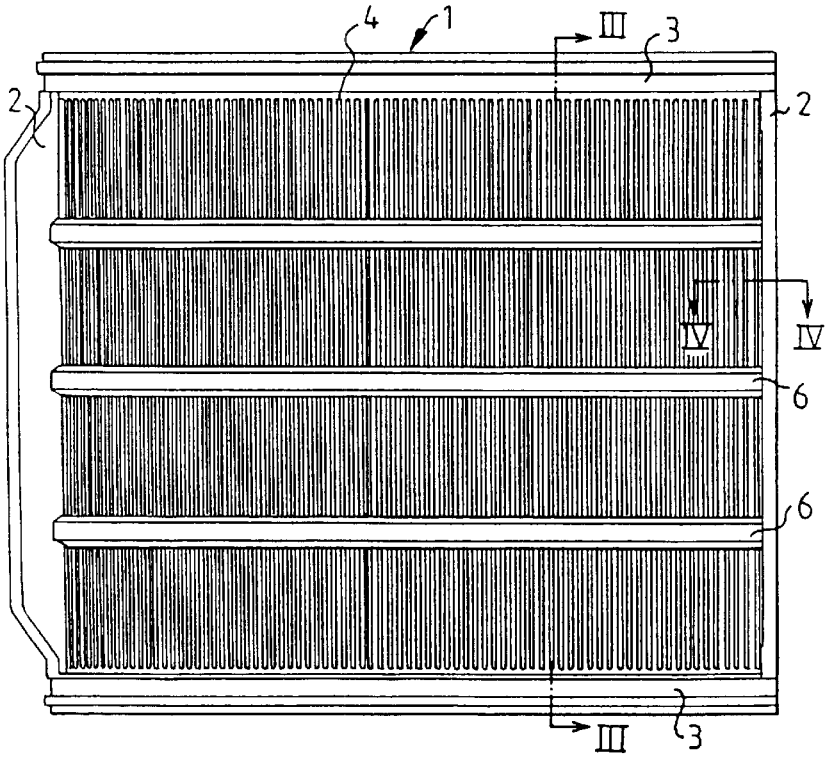
FIG. 2 is a front, elevational view of the screen panel shown in FIG. 1.
Figure 3:
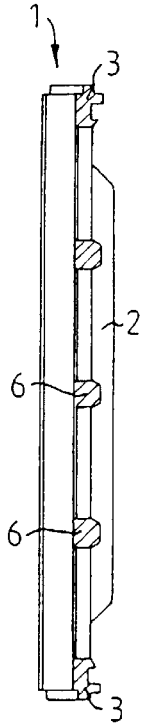
FIG. 3 is a side, elevational, sectional view of the screen panel of FIG. 2, taken along line III—III thereof.

Each panel is preferably formed by casting according to the shell molding method, precision casting or centrifugal casting. The casting mold has the shape desired for the finished panel. In FIG. 4 the profile of the screen surface is shown with deep axial grooves 4 on one side and recesses 5 on the other side. The panel also includes a number of support rings 6, which extend substantially in the circumferential direction. The support rings are formed in one piece with the panel and extend along the entire surface of the panel on the same side as the grooves 4.

After casting, a certain adjustment in the shape of the panel can be made by bending. The panel is provided with screening orifices in the form of slits 7 at the bottom of the grooves 4. The slits 7 are cut by precision grinding, electronic cutting or another precision method whereby a slit width of from about 0.1 to 1 mm can be obtained. The surfaces of the screening orifices can be improved, and the slit width can be adjusted, by polishing. The slit width can also be adjusted by after-bending the panel.

The present invention demonstrates that a slitted screening cylinder can be manufactured with great dimensional accuracy and with a great open area without deteriorating its strength. The screen panels are assembled to a cylinder in a suitable manner, for example by means of screw unions, holding rings, or in some other way.

A screening cylinder manufactured from screen panels according to the present invention can be provided with high precision and great strength. It is easy to mount and can be formed of highly wear-resistant material, ensuring long service life. Due to the high precision of the screening orifices, the screening result can also be improved.

The support rings 6 yield a substantial increase in strength of the screen panel and offer the possibility of high dimensional accuracy of the slits 7, while at the same time the open area can be maximized. The support rings also imply that the grooves 4 and slits 7 can have a direction deviating from the axial one without deteriorating the strength.

The wear-resistance of the screen panel can be improved by surface treatment of the edge flanges 2 and fastening means 3 in a suitable manner, for example by nitration or hardening.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A screen panel adapted to constitute a portion of a screening cylinder for the screening of fibrous material, said screen panel comprising a unitary screen panel of wear-resistant material having a first surface, a second surface, an upper edge, a lower edge, and a pair of side edges, said first surface including a plurality of axially extending grooves, a plurality of slit-shaped screening orifices disposed at the bottom of said plurality of axially extending grooves, at least one support ring extending circumferentially across said first surface and being integral with said screen panel, and assembly means for assembling said screen panel into said screening cylinder without the use of welding.

2. The screen panel of claim 1 including a plurality of said support rings.

3. The screen panel of claim 1 including a plurality of recesses on said second surface of said screen panel at a location directly in front of said plurality of axially extending grooves.

4. The screen panel of claim 1 wherein said plurality of slit-shaped screening orifices have a slit width of between about 0.5 and 1 mm.

5. The screen panel of claim 1 wherein said assembly means comprises at least one flange formed on one of said pair of side edges.

6. The screen panel of claim 5 wherein said assembly means further comprises additional fastening members disposed along said top and bottom edges of said screen panel.

* * * * *